US005872525A

United States Patent [19]

Fukasawa et al.

[11] Patent Number: 5,872,525

[45] Date of Patent: Feb. 16, 1999

[54] TOLL COLLECTION SYSTEM

[75] Inventors: Kazuo Fukasawa; Masato Namiki, both of Kanagawa-ken; Hideaki Kojima, Tokyo; Kazutoshi Naito; Kazuyuki Hashimoto, both of Kanagawa-ken, all of Japan

[73] Assignee: Kabushiki Kaisha Toshiba, Kawasaki, Japan

[21] Appl. No.: 596,866

[22] Filed: Feb. 9, 1996

[30] Foreign Application Priority Data

Feb. 10, 1995 [JP] Japan ..... 7-023005
Feb. 10, 1995 [JP] Japan ..... 7-023008

[51] Int. Cl.[6] ..... G08G 1/00

[52] U.S. Cl. ..... 340/928; 340/933; 364/436; 235/384

[58] Field of Search ..... 340/928, 933; 364/436; 235/384, 375, 383

[56] References Cited

U.S. PATENT DOCUMENTS 3,686,627 8/1972 Rubenstein ..... 340/928
3,794,966 2/1974 Platzman ..... 340/31 R
4,068,211 1/1978 Tol ..... 340/933
4,338,587 7/1982 Chiapetti ..... 340/928
4,789,941 12/1988 Nunberg ..... 364/436
5,101,200 3/1992 Swett ..... 340/937
5,204,675 4/1993 Sekine ..... 340/933
5,565,857 10/1996 Lee ..... 340/825.34

FOREIGN PATENT DOCUMENTS 5-017606 2/1993 Japan .

*Primary Examiner*—Jeffery Hofsass
*Assistant Examiner*—Anh La
*Attorney, Agent, or Firm*—Cushman, Darby & Cushman IP Group of Pillsbury, Madison &Sutro LLP

[57] ABSTRACT

A radio communication system is provided at an entrance gate of traffic facilities for radio communicating with a communication device carried by a vehicle. The system includes a first communication unit for transmitting first entrance data relative to the entrance gate of the traffic facilities to the communication device carried by the vehicle coming into the entrance gate, a discriminating unit for determining a vehicle type showing a kind of incoming vehicle, and a second communication unit, provided on an opposite side of the entrance gate from the first communication unit, along a direction of progress of the vehicle, for transmitting a second entrance data including data relative to the determined vehicle type to the communication device when the first communication unit transmits the first entrance data to the communication device.

16 Claims, 14 Drawing Sheets

FIG. 7A1
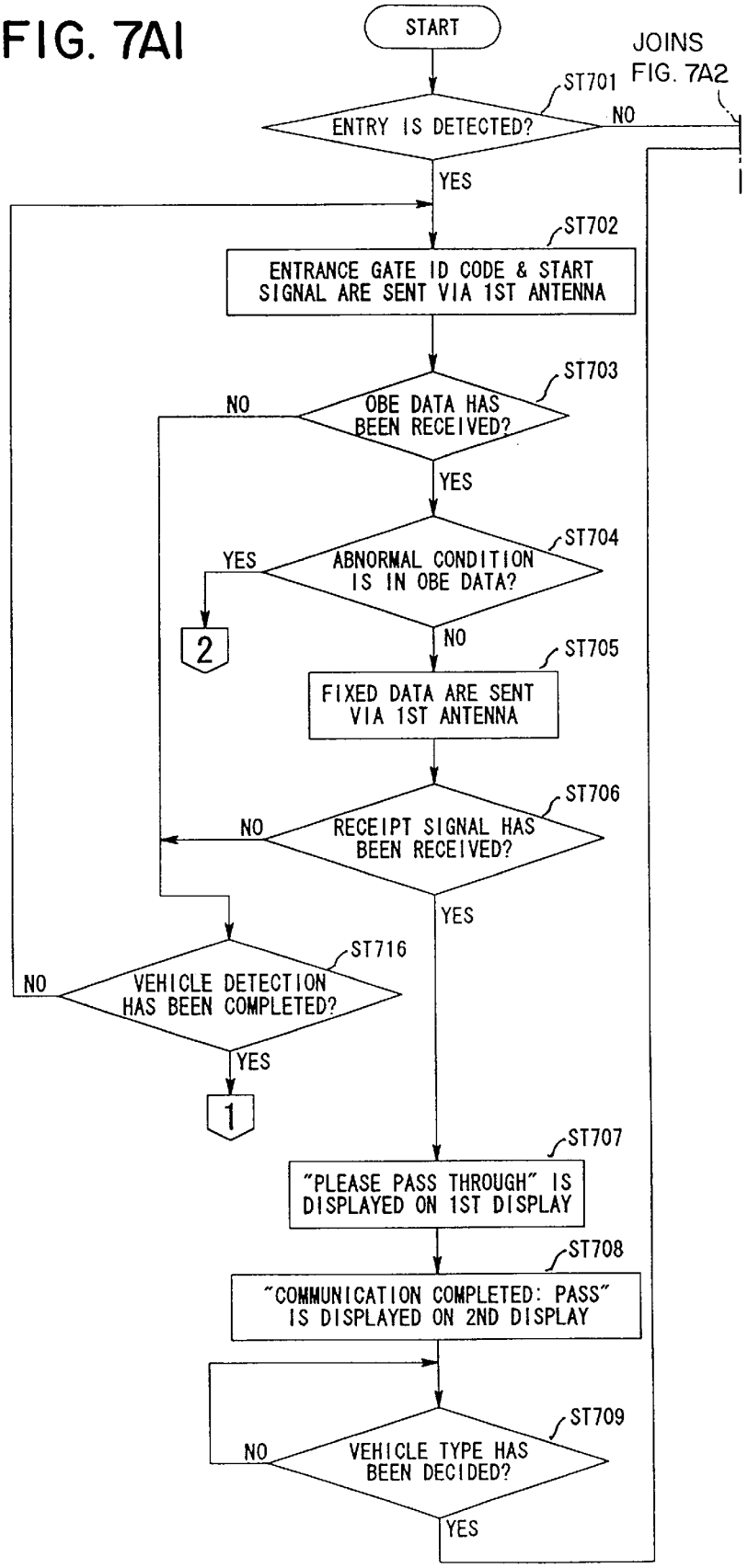

FIG. 7A2
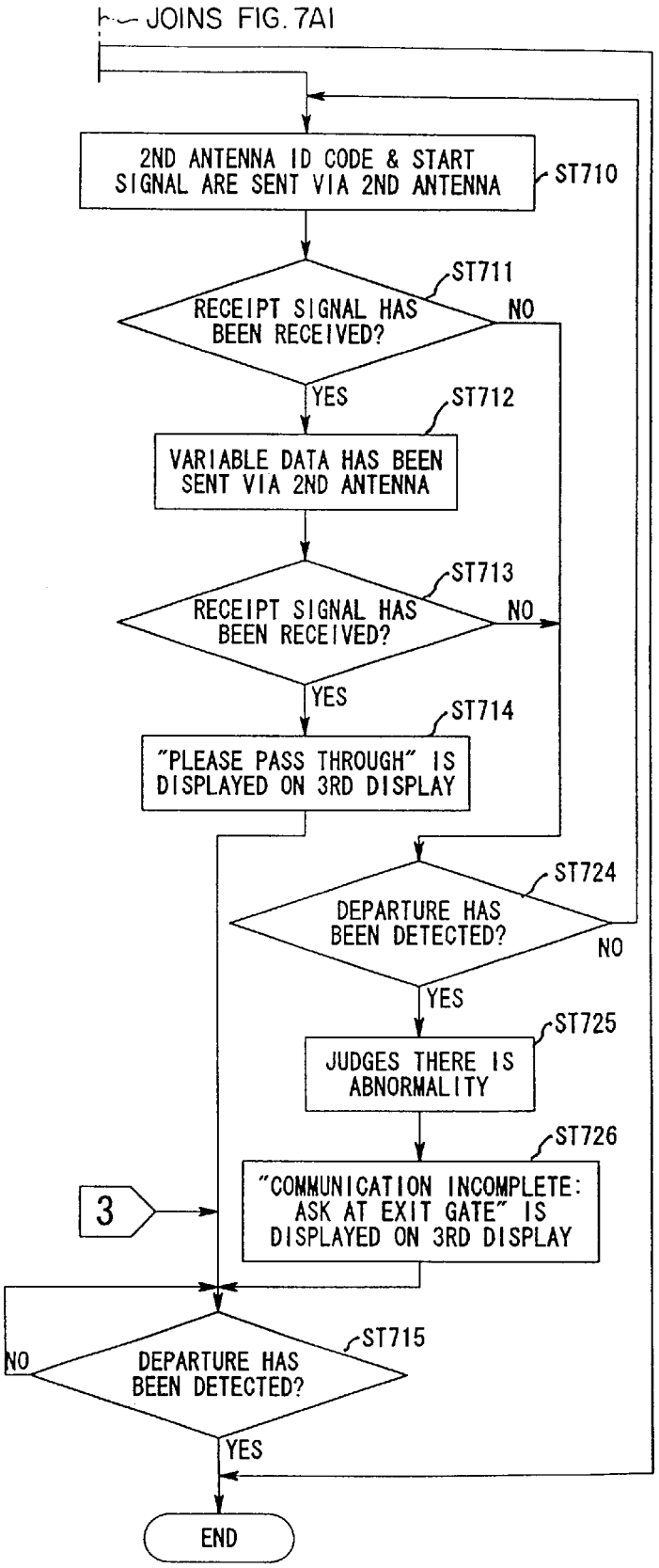

TOLL COLLECTION SYSTEM

BACKGROUND OF THE INVENTION

1. Field of the Invention

The present invention relates to, for instance, a toll collection system which exchanges required information with an on-board equipment (OBE) carried on an incoming vehicle through a radio communication at a tollgate of a toll road, e.g., an expressway.

2. Description of the Related Art

On a toll expressway, a ticket is issued to a user on a vehicle coming into the entrance gate of a tollhouse from an entrance gate official and the ticket is turned over to an exit gate official of the tollhouse. The exit gate official calculates a toll based on data recorded on the ticket turned over and collects the toll from the user.

Data recorded on a ticket are an entrance gate identification (ID) code, a vehicle type, an entrance gate passing time and the like. Of these data, a vehicle type is automatically determined by a vehicle type discriminator which is provided at the entrance lane. Elements for determining a vehicle type are overall length, height and number of axles. The capital letter of a number plate of a vehicle that is detected by a video camera may be added.

A problem in such a present toll collection system is that each vehicle has to stop when getting and turning over a ticket thus, causing traffic congestion. The handling of the ticket itself is troublesome for a user and moreover, he has to open/close the window.

A system is considered which calculates and collects a toll without using a ticket by providing a radio communication controller at the entrance and exit gate of a tollhouse, providing on-board equipment (OBE) having a communication function on each vehicle and exchanging data with this OBE when passing through the entrance and exit gates. According to this system it is possible to collect a toll rapidly without requiring a tollhouse official to contact a user during the vehicle passing process and sharply reducing a vehicle passing process time. This will solve the traffic congestion problem.

Data transmitted to the OBE from the radio communication controller are an entrance gate ID code, a vehicle type, an entrance gate passing time and the like, the same as the data that would be recorded on a ticket.

As an example of a toll collection through radio communication as described above, a system has been disclosed in the Japanese Patent Disclosure (Kokai) No. 06-232820 (laid open to public inspection on Aug. 19, 1994).

However, in this radio communication system, an automatic ticket issuing machine (ATIM) is required to cope with an abnormality in the communication. In other words, if no response is sent from the on-board equipment in response to the data sent from the radio communication controller, the transmission is judged abnormal and a ticket is issued to a user. Data to be recorded on the ticket are an entrance gate ID code, a vehicle type, an entrance gate passing time and the like, the same as above. At an exit gate, an exit gate official gets the ticket from the user and calculates and collects a toll based on the data recorded on the ticket.

The entrance gate ID code and the entrance gate passing time are transmitted to the on-board equipment from the antenna at a tollgate immediately after the vehicle enters the entrance gate of the tollhouse and the result of this transmission will soon be known.

On the other hand, a vehicle type is automatically determined by a vehicle type discriminator provided at the entrance lane. The vehicle type is decided when the rear of the vehicle passes the vehicle type discriminator in order to detect a timing of completing the process for one vehicle, and data are finally transmitted to the on-board equipment via the antenna of the tollgate. Thereafter, the transmission result is known.

If the overall length of a vehicle is not long as in ordinary vehicles, even when data are transmitted to the on-board equipment from the antenna at the tollgate when a vehicle type is determined after the rear of the vehicle passes the vehicle type discriminator, there is sufficient time and distance until the vehicle arrives at the location of the ATIM after the result of data transmission is known. Therefore, if the transmission is abnormal, a user is able to pass through the tollgate smoothly while perceiving the necessity for getting a ticket in advance.

However, if a vehicle is long and large such as a full trailer (overall length 18m), semi-trailer (overall length 12 m) and large-sized bus (overall length 12 m), a vehicle type is finally determined when the front of a vehicle comes considerably close to the ticket issuing machine and data are transmitted to the on-board equipment from the antenna of the tollgate. Thus, there is not much time at all when the vehicle arrives at the location of the ticket issuing machine after the result of the data transmission is known.

Therefore, if the communication is abnormal, a user on a long and large-sized vehicle becomes aware of the necessity for getting a ticket immediately before or in front of the ATIM and has to stop the vehicle suddenly.

Further, in such a radio communication type toll collection system, electronic waves for radio communication are constantly sent to the vehicle from the antenna installed at the road side. Or, a method was adopted, wherein the transmission of radio waves to a vehicle begins when detecting the passage of the vehicle and the radio communication process terminated when the vehicle passed an no vehicle was present in a communication area.

However, in such a conventional radio communication process, the vehicle and preceding as well as succeeding vehicles run close together in particular, on a toll road where there is much traffic volume and congestion. Therefore, a phenomenon will be produced, wherein onboard vehicle units carried on preceding and succeeding vehicles and on-board equipment carried on the current vehicle are present in the same radio communication area. As a result, there is a problem such that the preceding and succeeding vehicles produce interference from the radio waves transmitted from the onboard vehicle units and the communication cannot be processed properly.

SUMMARY OF THE INVENTION

It is an object of the present invention to provide a radio communication system which is capable of allowing a vehicle to pass through a lane smoothly without stopping suddenly, thus sharply promoting safety while reducing a passing process time, eliminating traffic congestion and reducing a burden on a user.

It is a further object of the present invention to provide a radio communication system which is capable of properly processing communications with on-board equipment carried on a vehicle while reducing a process error caused by the preceding and succeeding vehicle interference.

According to the present invention, there is provided a radio communication system, provided at an entrance gate of traffic facilities, for communicating with a communication device carried by a vehicle, the system comprising first communication means for transmitting a first entrance data relative to the entrance gate of the traffic facilities to the communication device carried by the vehicle coming into the entrance gate; means for determining a vehicle type showing a kind of incoming vehicle; and second communication means, provided on the other side from the first communication means along a direction of the progress of the vehicle, for transmitting a second entrance data including data relative to the determined vehicle type to the communication device when the first communication means transmits the first entrance data to the communication device.

Further, according to the present invention, there is provided a radio communication system comprising vehicle detection means for detecting a vehicle, carrying an on-board equipment, coming into a prescribed location; axle detection means for detecting the number of axles of the incoming vehicle; and radio communication means for starting the radio communication with the on-board equipment carried by the incoming vehicle when the axle detection means detects the incoming vehicle and stopping the radio communications with the on-board equipment carried by the incoming vehicle when the axle detection means detects the incoming vehicle and stopping the radio communication with the on-board equipment carried by the incoming vehicle when the axle detection means detects the second axle of the incoming vehicle.

BRIEF DESCRIPTION OF THE DRAWINGS

FIGS. 7A1 and 7B2 are flowcharts for explaining the operations at the entrance lane;

DETAILED DESCRIPTION OF THE PREFERRED EMBODIMENTS

A first embodiment of a toll collection system of the present invention will be described referring to the attached drawings.

Figure 1:
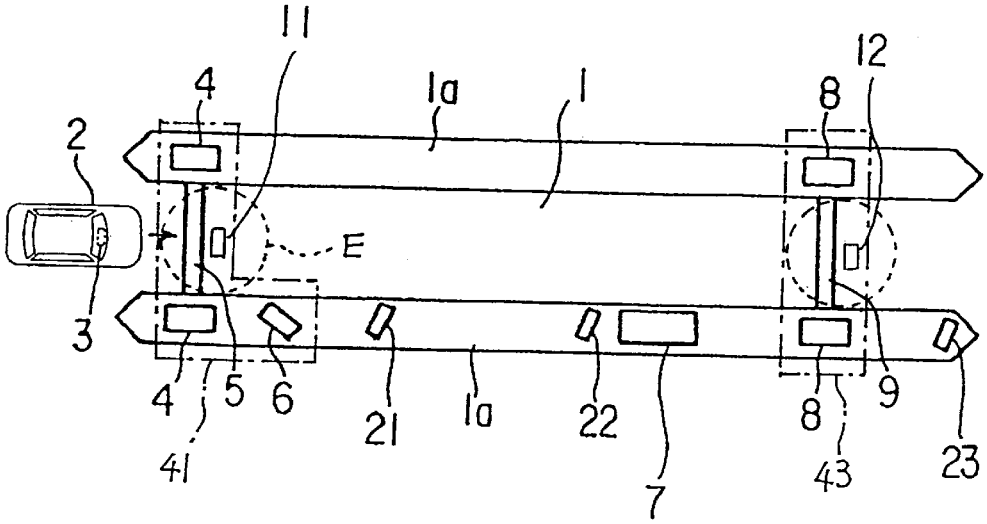
FIG. 1 is a plan view showing an entrance lane of a toll collection system of the present invention.
Figure 2:
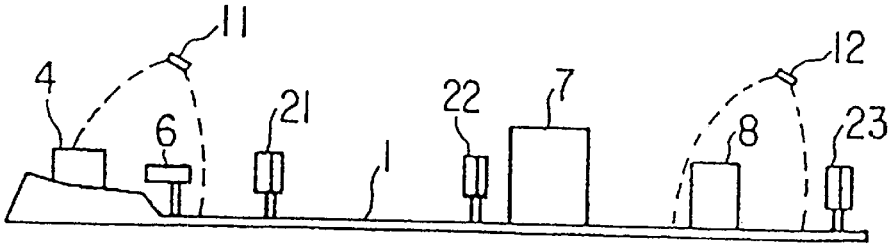
FIG. 2 is a side view of the entrance lane shown in FIG. 1.

In FIGS. 1 and 2, an entrance gate processing apparatus is provided at an entrance lane 1 of the tollgate provided in a toll expressway. A vehicle 2 is now going to enter into this entrance lane 1 from a general road (not shown). This vehicle 2 is carrying a communication device such as an on-board equipment (hereinafter referred to as OBE) 3 which has a communication function.

The entrance lane 1 is defined by a pair of islands 1*a*. An optical sensor 4 for discriminating a vehicle type, a tread sensor 5 and a video camera 6 are provided at one end (the general road side) of the islands 1*a*.

The optical sensor 4 detects the overall length and height of the vehicle 2 and the presence of another vehicle. A piezoelectric switch is used for the tread sensor 5 and detects the number of axles of the vehicle 2 by being tread on by the wheels. The video camera 6 takes a picture of the number plate of the vehicle 2. These optical sensor 4, the tread sensor 5 and the video camera 6 are the structural elements of the vehicle type discriminator 41. A type of the vehicle 2 is determined by this vehicle type discriminator 41.

There is an automatic ticket issuing machine (hereinafter referred to as ATIM) 7 provided at the middle of the islands 1*a*. The ATIM 7 issues a ticket to the incoming vehicle 2 as required. An entrance ID code, a vehicle type, an entrance gate passing time, etc. are magnetically recorded on the ticket. A vehicle type is determined by the vehicle type discriminator 41, which will be described later.

At another end (the main lane side of the expressway) of the islands 1*a*, an optical sensor 8 and a tread sensor 9 for vehicle detecting are provided. The optical sensor 8 optically detects the overall length from the front to the rear of the vehicle 2 and the presence of another vehicle. A piezoelectric switch is used for the tread sensor 9 for detecting the number of axles of the vehicle 2 by being tread on by the wheels. The optical sensor 8 and the tread sensor 9 are the structural elements of a vehicle detector 43 which will be described later. The departure of the vehicle 2 (getting out of the entrance lane) is detected by the vehicle detector 43. Further, the optical sensor 8 and the tread sensor 9 have been adopted like the optical sensor 4 and the tread sensor 5 from the necessity for bringing an incoming vehicle 2 in accord with a departing vehicle 2.

There is a first antenna 11 provided above the one end of the entrance lane 1, that is, near the optical sensor 4, the tread sensor 5 and the video camera 6 which are provided at an inlet port of the entrance lane 1. The first antenna 11 is for transmitting such data as an IC code (a fixed data relative to the entrance gate) showing a tollhouse (Interchange; IC) of a toll expressway, Lane No. and the entrance lane 1 passing time commonly to the onboard vehicle units of all incoming vehicles. The first antenna 11 uses a phased array antenna and its directivity has been narrowed.

There is a second antenna 12 provided on the other side from the first antenna 11 along a direction of progress of the vehicle 2, that is, near the optical sensor 8 and the tread sensor 9 which are provided at an outlet port of the entrance lane 1. The antenna 12 is for transmitting variable data relative to the vehicle 2, that is, a vehicle type code and a vehicle number to the OBE 3. Like the first antenna 11, the second antenna 12 uses a phased array antenna and its directivity has been narrowed.

On the islands 1*a*, a first display 21 is provided behind the video camera 6, a second display 22 is provided in front of the ATIM 7, and a third display 23 is provided behind the optical sensor 8. These displays display various information relative to the passage and the toll collection of the entrance lane 1.

Figure 3:
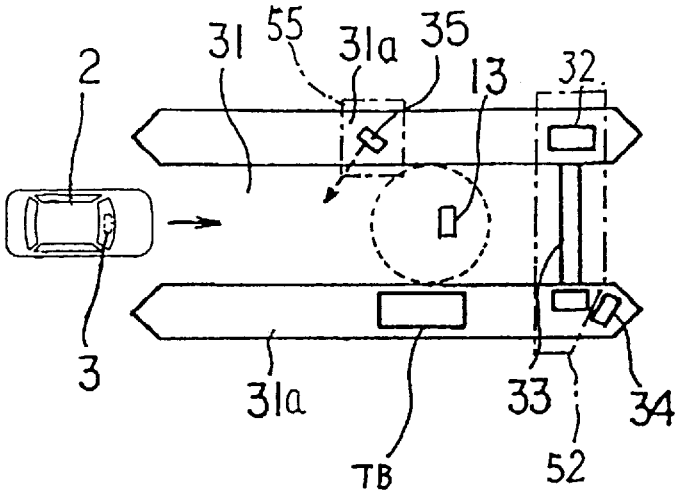
FIG. 3 is a plan view showing an exit lane of the toll collection system of the present invention.
Figure 4:
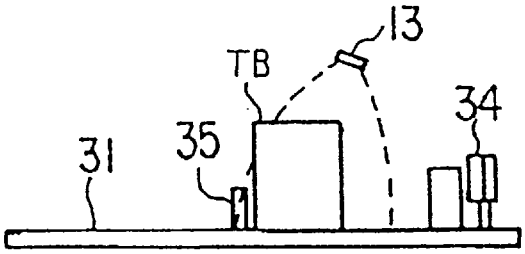
FIG. 4 is a side view of the exit lane shown in FIG. 3.

In FIGS. 3 and 4, an exit lane 31 is provided at a tollhouse of a toll expressway like the entrance lane 1. The vehicle 2 is going to enter into this exit lane 31 from the main lane of an expressway.

An exit gate processing apparatus is provided at an exit lane 31 of the tollgate provided in a toll expressway. The exit lane 31 is defined by a pair of islands 31*a*. An official booth TB is provided at the middle of the islands 31*a*. In this official booth TB, an official is always stationed.

At the other end (the general road side) of the islands 31*a*, an optical sensor 32 and a tread sensor 33 are provided for detecting vehicles. The tread sensor 33 uses a piezoelectric switch. The tread sensor 33 detects the number of axles of the vehicle 2 by being tread on by the wheels. The optical sensor 32 and the tread sensor 33 are the structural components of a vehicle detector 52 which will be described later. The departure of the vehicle 2 is detected by the vehicle detector 52.

At the other end (the general road side) of the islands 31*a*, a display 34 is provided. The display 34 displays various information relative to the passage of and the toll collection at the exit lane 31.

There is a third antenna 13 provided above the middle of the exit lane 31 (near the official booth TB). The antenna 13 is used for receiving fixed data as well as variable data from the vehicle 2 and transmitting data of the processing result of a toll, etc. at the exit gate to the OBE 3 of the vehicle 2. Like the first antenna 11, the third antenna 13 uses a phased array antenna and the directivity has been narrowed.

Figure 5:
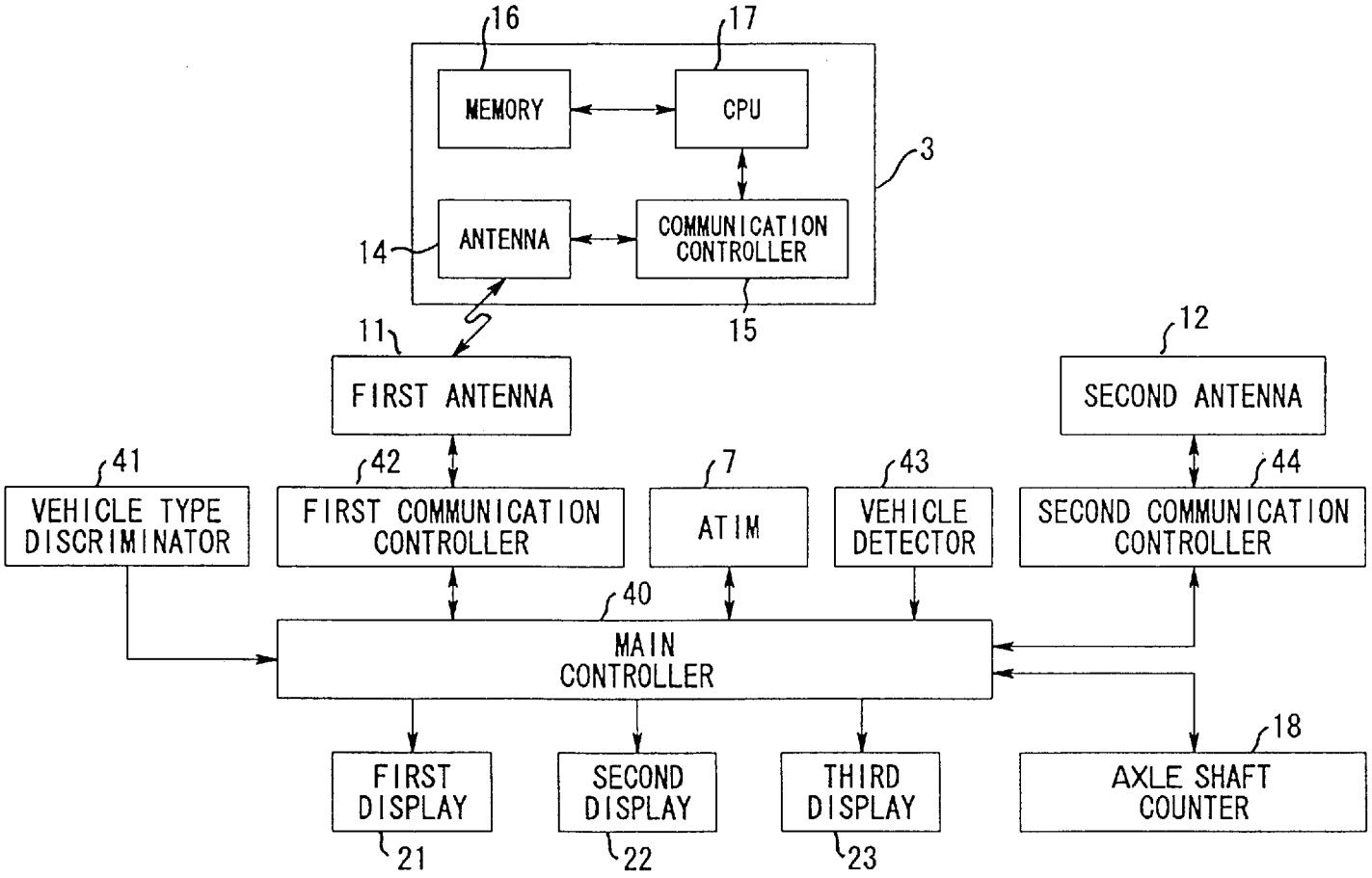
FIG. 5 is a block diagram of a control circuit at the entrance lane of the toll collection system of the present invention.

FIG. 5 shows a block diagram of a control circuit for controlling equipment at the entrance lane 1 and the OBE 3 carried on the vehicle 2. Further, this block diagram shows the state of the communication of the OBE 3 with the first antenna 11. The OBE 3 also communicates with the second antenna 12 but it was omitted in this block diagram.

A main controller 40 is connected to a host computer in a central control room. The ATIM 7, an axle shaft counter 18, displays 21, 22 and 23, the vehicle type discriminator 41, a first communication controller 42, a vehicle detector 43 and a second communication controller 44 are connected to the main controller 40.

The axle shaft counter 18 counts the number of axles of a vehicle passing through the optical sensor 4 and the tread sensor 5 based on detection signals from these sensors.

The vehicle type discriminator 41 is composed of the optical sensor 4, the tread sensor 5 and the video camera 6 as described above. The vehicle type discriminator 41 discriminates a type of the vehicle 2 according to the overall length and the number of axles of a vehicle to be detected and further, according to a kind of a number plate character perceived by the video camera 6.

The first communication controller 42 is equipped with the first antenna 11 and transmits fixed data supplied from the main controller 40 to the vehicle 2 via the first antenna 11. Further, the first communication controller 42 receives via the first antenna 11 data which are transmitted from the OBE 3, i.e., an ID code showing a code peculiar to each OBE, information on the term of validity, information on a vehicle showing a vehicle type and an attribute code showing whether a toll is to be prepaid or paid later.

The vehicle detector 43 is comprised of the optical sensor 8 and the tread sensor 9, and detects the departure of the vehicle 2 according to its overall length and the number of axles.

The second communication controller 44 is equipped with the second antenna 12 and transmits data supplied from the main controller 40, i.e., the vehicle type information discriminated by the vehicle type discriminator 41 to the vehicle 2 via the second antenna 12 and also, receives data transmitted from the vehicle 2 via the second antenna 12.

The OBE 3 is comprised of an antenna 14 which communicates with the first, second and third antennas 11, 12 and 13 by radio waves, a communication controller 15 which controls the antenna 14, a memory 16 which stores various information, and a CPU 17 which controls the entirety of these units and all of these units are contained in a housing. These units may be composed in a card shape using an IC card. In the invention, the IC card is also called an on-board equipment (OBE).

The memory 16 stores such data as the CPU 17 control program, ID code as identification information peculiar to an onboard vehicle unit, term of validity, vehicle information, etc. in advance. Furthermore, when vehicles pass through the tollgate, such data as the entrance gate ID code, the entrance gate number, entrance gate passing times, determined vehicle type information, etc. are stored in the memory 16.

The main controller 40 has the following [1] through [3] as the principal functional means:

[1] A first communication means for transmitting fixed data etc. as a first entrance data relative to the entrance to the vehicle 2 using the first communication controller 42.

[2] A ticket issuing means for issuing a ticket by giving an instruction to the ATIM 7 if the communication between the first communication means and the vehicle 2 is abnormal.

[3] A second communication means for transmitting variable data (a second entrance data) including vehicle type information, etc. to the vehicle 2 based on the result of the vehicle type discriminator 41 if the communication between the first communication means and the vehicle 2 is normal.

Figure 6:
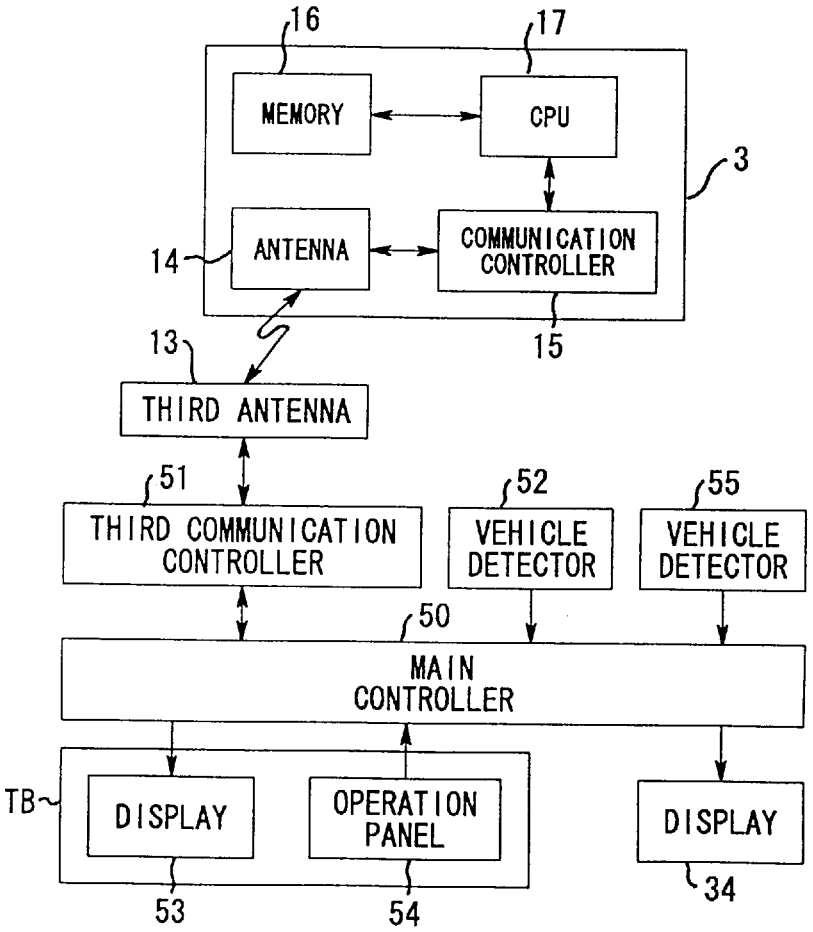
FIG. 6 is a block diagram of a control circuit at the exit lane.
Figure 7B:
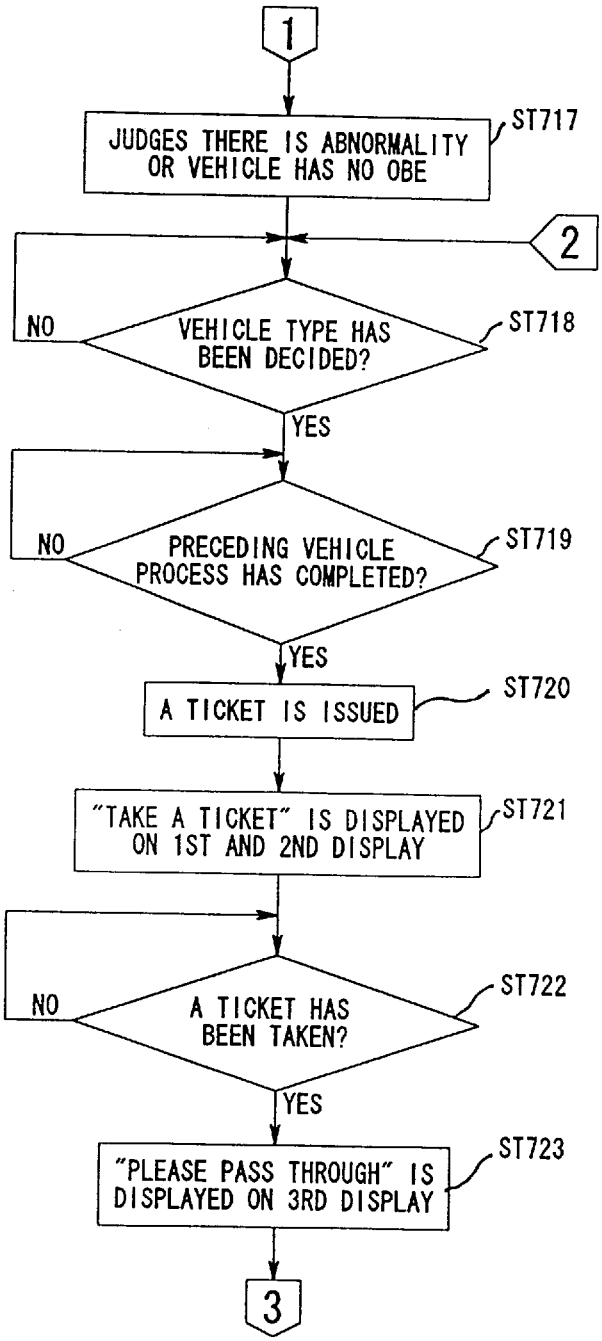

FIG. 6 shows a block diagram of a control circuit for controlling units at the exit lane 31 and the OBE 3 carried on the vehicle 2. Further, the explanation of the construction of the OBE 3 will be omitted as it has been already described in the explanation for FIG. 5.

A main controller 50 has been connected to the host computer in the central control room. A display 34, a third communication controller 51, vehicle detectors 52 and 55, a display 53 and a control panel 54 are connected to the main controller 50.

The third communication controller 51 is equipped with the third antenna 13, and transmits data supplied from the main controller 50 to the vehicle 2 via the third antenna 13 and receives data transmitted from the vehicle 2 via the third antenna 13.

The vehicle detector 52, comprising the optical sensor 32 and the tread sensor 33 as described above, detects the departure of the vehicle 2 according to the detected number of axles.

The vehicle detector 55, comprising the optical sensor 35, detects the entry of the vehicle 2 according to the reflected light from the vehicle.

The display 53 and the operation panel 54 are provided in the official booth TB for use by the exit official.

The main controller 50 has the following [1] through [4] as the principal functional means:

[1] A third communication means for receiving fixed data as well as variable data transmitted from the vehicle 2 via the third antenna 13.

[2] A calculation means for calculating a toll according to the contents of the data received by the third communication means.

[3] A calculation means for calculating a toll based on the fixed data received by the third communication means and the data input by the exit official through the operation panel 54 if no variable data are received by the third communication means.

[4] A notifying means for notifying a user of the requirement of receiving a ticket or notifying the exit official using the displays 34 and 53 when the contents of the data received by the third communication means are abnormal.

Figure 8:
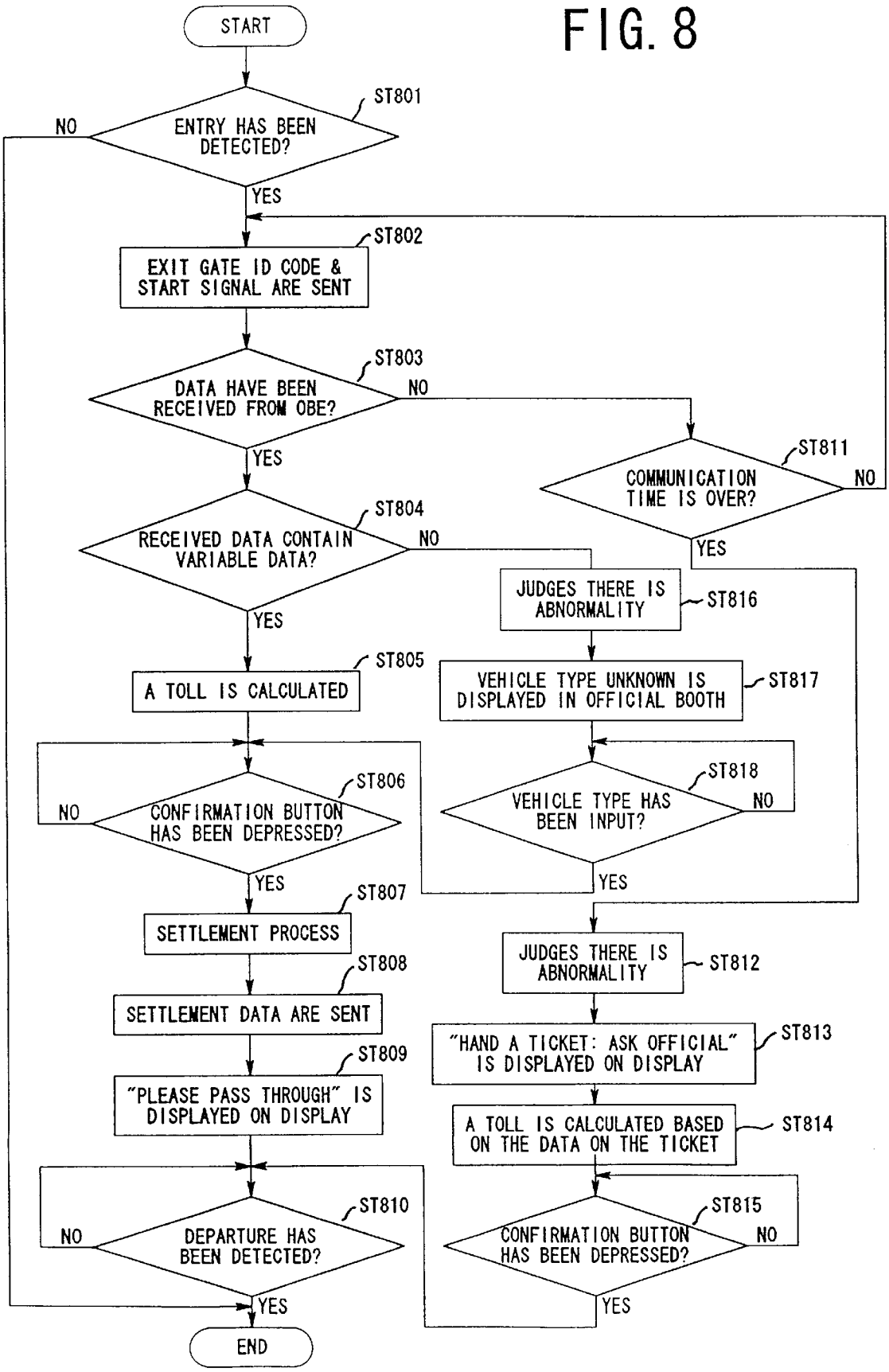
FIG. 8 is a flowchart for explaining the operations at the exit lane.
Figure 9:
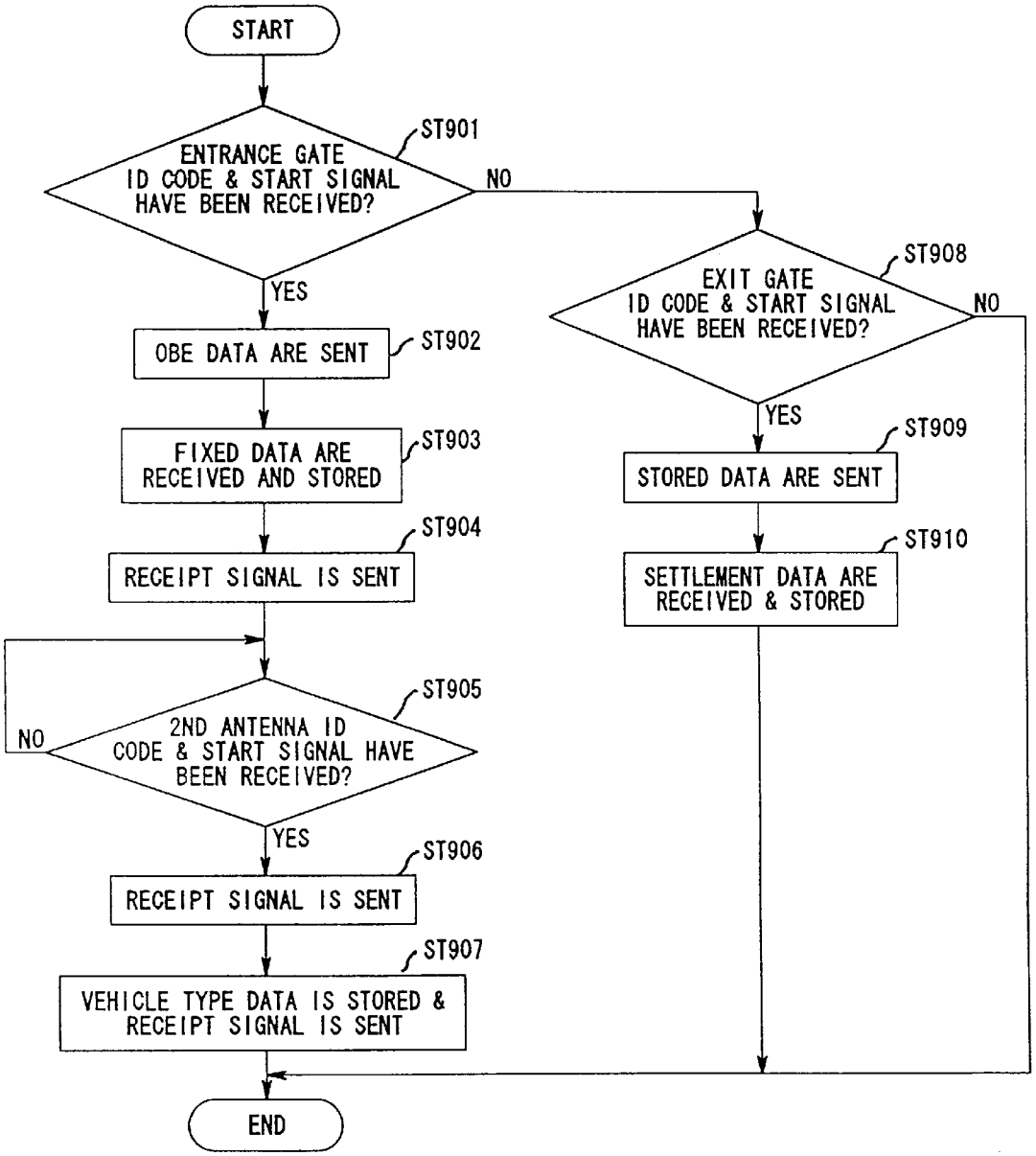
FIG. 9 is a flowchart for explaining the operation of an on-board equipment carried on a vehicle.

Now, the operation of the toll collection system constructed as shown above will be described referring to flowcharts shown in FIGS. 7A1 through 9. FIGS. 7A1 and 7B2 show the control operation at the entrance lane 1, FIG. 8 shows the control operation at the exit lane 31 and FIG. 9 shows the control operation of the OBE 3.

When the front of the vehicle 2 enters into the entrance lane 1, the entry is detected by the vehicle type discriminator 41 (the optical sensor 4 and the tread sensor 5) (YES in ST701). At this time, the entrance gate ID code, which is one of the fixed data relative to the entrance gate, and a start signal for the OBE 3 are transmitted via the first antenna 11 to the OBE 3 (ST702).

Upon receipt of the entrance gate ID code and the start signal (YES in ST901), the OBE 3 transmits OBE data (ID code, attribute code, term of validity, vehicle information, etc.) which are pre-stored in the OBE 3 to the first antenna 11 (ST902).

When the OBE data are received (YES in ST703) and no abnormal condition (the expiration of the term of validity, etc.) is contained in the OBE data (NO in ST704), the entrance gate passing time data, which is the remainder of the fixed data relative to the entrance gate, is transmitted via the first antenna 11 (ST705).

The OBE 3 stores the received fixed data (the entrance gate ID code and the entrance gate passing time data) (ST903) and transmits a receipt signal to the first antenna 11 (ST904).

When the first antenna 11 receives the receipt signal from the OBE 3 (YES in ST706), the information "PLEASE PASS THROUGH" is displayed on the first display 21 (ST707) and further, the letters "COMMUNICATION COMPLETED: PASS" are displayed on the second display 22 (ST708).

The vehicle type discriminator 41 (the optical sensor 4, the tread sensor 5 and the video camera 6) is continuously determining the vehicle type and the vehicle type is decided when the rear of the vehicle 2 has passed the location of the optical sensor 4.

When the vehicle type has been decided (YES in ST709), the second antenna ID code which is peculiar to the second antenna 12 and a start signal for the OBE 3 are transmitted via the second antenna 11 (ST710).

Upon receipt of the second antenna ID code an the start signal (YES in ST905), the OBE 3 transmits the receipt signal to the second antenna 12 (ST906).

When the receipt signal from the OBE 3 is received by the second antenna 12 (YES in ST711), variable data (the vehicle type, Number Plate Number, the entrance gate passing time, etc.) based on the result of the determination of the vehicle type discriminator 41 are transmitted to the OBE 3 via the second antenna 11 (ST712).

The OBE 3 receives and stores the variable data including the vehicle type transmitted via the second antenna 12 and transmits a receipt signal to the second antenna 12 (ST907).

When the second antenna 12 receives the receipt signal from the OBE 3 (YES in ST713), the information "PLEASE PASS THROUGH" is displayed on the third display 23 (ST714), and after the departure of the vehicle 2 has been detected by the vehicle detector 43 (YES in ST715), the entrance gate process for one vehicle 2 is completed.

If the rear of the vehicle 2 passed the location of the optical sensor 4 and the vehicle detection by the vehicle type discriminator 41 was completed (YES in ST716) without receiving the OBE data of the vehicle 2 (NO in ST703), the vehicle 2 is determined to be a vehicle carrying no OBE 3 (ST717).

If the vehicle detection by the vehicle type discriminator 41 was completed (YES in ST716) without receiving the receipt signal of the vehicle 2 by the first antenna 11 (NO in ST706), the communication is judged to be abnormal (ST717).

When a vehicle has no OBE 3 or the communication is abnormal, after the vehicle type has been determined by the vehicle type discriminator 41 (YES in ST718) and further, the entrance gate process for a preceding vehicle has been completed (departed) (YES in ST719), a ticket is issued by the ATIM 7 (ST720). On this issued ticket, such data as an entrance gate ID code, a vehicle type, an entrance gate passing time, etc. are magnetically recorded and at the same time, the information "PLEASE TAKE A TICKET" is displayed on the first display 21 and the second display 22 (ST721).

Further, even when the first antenna 11 could receive the OBE data of the vehicle 2 (YES in ST703), if the OBE data contained any abnormal condition (the expiration of the validity term, etc.) (YES in ST704), upon completion of the vehicle type decision by the vehicle type discriminator 41 (YES in ST718) and further, the entrance gate process for a preceding vehicle (the departure of the preceding vehicle (YES in ST719), a ticket is issued from the ATIM 7 (ST720). At the same time, the information "PLEASE TAKE A TICKET" is displayed on the first display 21 and the second display 22 (ST721).

When the issued ticket is taken by a user of the vehicle 2 from the ATIM 7 (YES in ST722), the information "PLEASE PASS THROUGH" is displayed on the third display 23 (ST723), and when the departure of the vehicle 2 was detected by the vehicle detector 43 (YES in ST715), the entrance gate process for one vehicle 2 is completed.

Further, if the communication is abnormal or a vehicle has no OBE 3, the data exchange will not be carried out between this OBE 3 and the second antenna 12.

If the departure of the vehicle 2 has been detected (YES in ST724) without receiving the receipt signal from the vehicle 2 by the second antenna 12 (NO in ST711 or NO in ST713), it is judged that there is an abnormality (ST725) and the information "COMMUNICATION INCOMPLETE: ASK AT THE EXIT GATE" is displayed on the third display 23 (ST726). That is, in the state where it is unknown as to whether variable data could be supplied to the vehicle 2 from the second antenna 12, the vehicle type discrimination is entrusted to the judgment of the exit gate official at the exit lane 31 and the vehicle 2 is allowed to pass through the entrance lane 1 without stopping.

On the other hand, when the vehicle 2 of which entrance gate process has been completed enters into the exit lane 31, the entry is detected by the vehicle detector 55 (the optical sensor 35) (YES in ST801). At this time, the exit gate ID code which is one of the fixed data relative to the exit gate and a start signal for the OBE 3 are transmitted via the third antenna 13 (ST802).

Upon receipt of the exit gate ID code and the start signal (YES in ST908), the OBE 3 transmits the data (the fixed and variable data) stored at the entrance lane 1 to the third antenna 13 (ST909).

If the data of the OBE 3 could be received by the third antenna 13 (YES in ST803) and variable data are contained in the received OBE 3 data (YES in ST804), a toll is calculated based on the received data (the fixed and variable data) (ST805). This toll is displayed on the display 53 in the official booth TB to inform an exit gate official. The exit gate official confirms the display of a toll and depresses the confirming button on the operation panel 54.

When the confirmation button has been depressed (YES in ST806), the settlement process is executed between this system and the host computer according to the credit or prepaid system based on the calculated toll (ST807).

Upon completion of the settlement process, the settlement data is transmitted to the OBE 3 via the third antenna 13 (ST808) and the information "PLEASE PASS THROUGH" is displayed on the display 34 (ST809). Then after the departure of the vehicle 2 has been detected by the vehicle detector 52 (the optical sensor 32 and the tread sensor 33) (YES in ST810), the exit gate process is completed.

The OBE 3 receives and stores the settlement data transmitted via the third antenna 13 (ST910).

Further, if a vehicle has no OBE 3, no data is transmitted from the vehicle 2 even when the exit gate ID code and the start signal are transmitted via the third antenna 13 and therefore, no data can be received (NO in ST803). Not only a vehicle equipped with no OBE 3 but also abnormality of the communication itself are considered to be causes for non-receipt of data.

If a prescribed communication time has passed (YES in ST811) without receiving the receipt signal from the vehicle 2 by the third antenna 13 (NO in ST803) and it is judged that there is an abnormality (ST812), the information indicating an abnormal communication "HAND OVER A TICKET: ASK AN OFFICIAL" is more specifically displayed on the display 34 (ST813).

If a vehicle has no OBE 3, a passenger of that vehicle has a ticket and an exit gate official receives the ticket from the passenger. The data magnetically recorded on the ticket are read out by a magnetic reader and a toll is calculated based on the recorded data by the main controller 50 (ST814).

If a vehicle has the OBE 3, judging that some trouble might have occurred in the communication equipment, such as the OBE 3, proper action will be taken by introducing the vehicle 2 into a special lane. Then, upon completion of the process according to a ticket or the introduction of the vehicle 2 into the special lane, the exit gate official depresses the confirmation button on the operation panel 54.

When the confirmation button has been depressed (YES in ST815), the exit gate process will be completed after detecting the departure of the vehicle by the vehicle detector 52 (YES in ST810).

Further, when the date of the vehicle 2 could be received (YES in ST803) but no variable data are contained in the received data (NO in ST804), it is judged that there is an abnormality (ST816) and the effect that a vehicle type is unknown is displayed on the display 53 in the official booth TB (ST817). According to the display, an exit gate official visually checks a type of the vehicle 2 and key inputs the vehicle type data through the operation panel 54.

When the vehicle type data is input (YES in ST818), a toll is calculated based on this input data and received data (fixed data only) (ST805). The subsequent process will be the same as described above.

Thus, by the collection of a toll based on the communication with the vehicle 2 without contacting an official, a passing process time at the entrance lane 1 and the exit lane 31 is reduced and no traffic congestion occurs. For a user of the vehicle 2 it becomes unnecessary to open/close the driver's window, reducing a burden and the inside the vehicle remains comfortable as the warm or cool air does not escape.

In particular, as fixed data relative to the entrance gate are transmitted via the first antenna 11 and variable data relative to the vehicle 2 are transmitted via the second antenna 12 provided at the rear and a sufficient time is secured for the communication with the vehicle 2, it is possible to provide variable data reasonably to the vehicle 2 even when it is a large-sized vehicle in a long overall length and it is therefore possible to allow the vehicle 2 to pass the tollgate smoothly without stopping suddenly, thus sharply promoting safety.

In the ATIM 7 provided, toll collection is assured without being affected by abnormal communication or a commingled vehicle not equipped with an OBE 3.

Regarding the correlation among the first antenna 11, the ATIM 7 and the second antenna 12, as variable data based on the vehicle type decision are transmitted via the second antenna 12 only, abnormal communication relative to variable data will not be contained in abnormal communication between the first antenna 11 and the vehicle 2. Therefore, even in the state where the timing for the vehicle type decision is delayed such as in a long and large-sized vehicle, it is absolutely not necessary for the vehicle 2 to stop suddenly (in order to take a ticket).

So, as a matter of course, abnormal communication relative to variable data might be contained in abnormal communication at the second antenna 12 side. However, in the abnormal communication, that is, in the state whether variable data could not be supplied to the vehicle 2 and thus, is not known, it will not be absolutely necessary for the vehicle 2 to suddenly stop because the vehicle type determination is entrusted to the judgment of the exit gate official at the exit lane 31.

Further, although the application of the present invention to a toll expressway has been described in the above embodiment, it is also applicable to other means of transport provided that both an entrance and an exit gate are available.

In the of the operations at the entrance lane in the above embodiment, ST701 through 706 and 716 in the flowchart shown in FIG. 7A1 and the operations of ST901 through 904 in the flowchart shown in FIG. 9 are the communicating operations when the vehicle 2 passes through the communication area of the first antenna 11.

Then, an embodiment of the present invention, wherein a solution to the problem of the preceding and succeeding vehicle interference, which tends to occur when the vehicle 2 passes through the communication area of the first antenna 11, will be explained.

Figure 10:
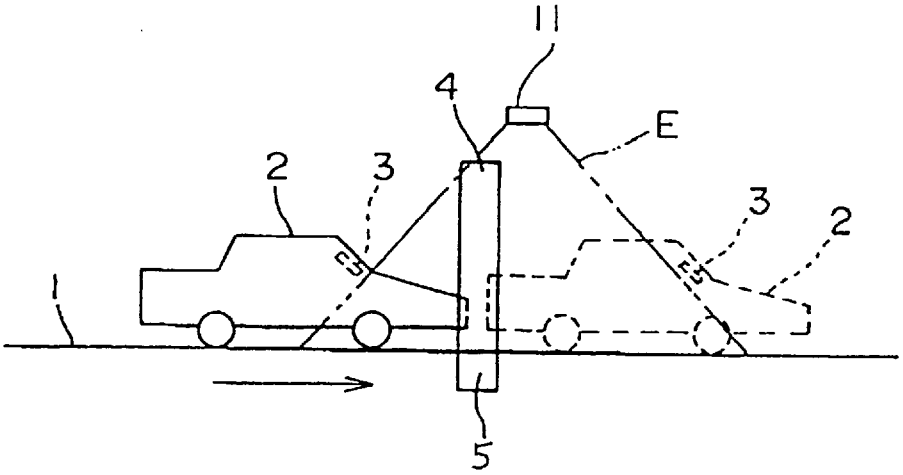
FIG. 10 is a schematic side view for explaining a cause generating the preceding and succeeding vehicles interference using a passenger car as an example.
Figure 11:
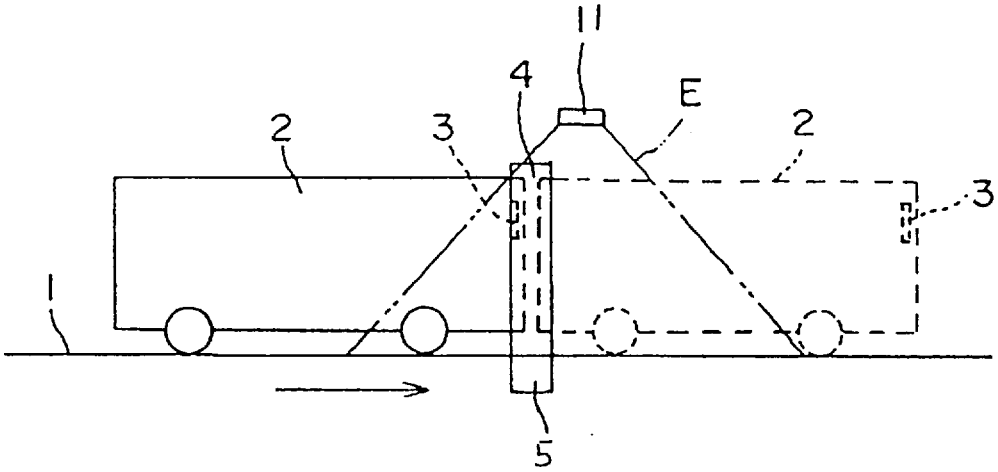
FIG. 11 is a schematic side view for explaining a cause generating the preceding and succeeding vehicles interference using a bus as an example.

First, a cause of the preceding and succeeding vehicle interference will be briefly explained. FIGS. 10 and 11 show the state of the vehicle 2 going into the entrance gate. FIG. 10 is a diagram showing a case where the vehicle 2 is a passenger car and FIG. 11 is a diagram showing a case where the vehicle 2 is a bus. Both FIGS. 10 and 11 indicate the front of the vehicle 2 entering into the entrance gate and its rear passing the entrance gate. The vehicles entering and passing through the entrance gate are detected by the optical sensor 4 triggering the start and termination of transmission via the first antenna 11. A reference letter E in the figures denotes the communication area of the first antenna 11.

Figure 12:
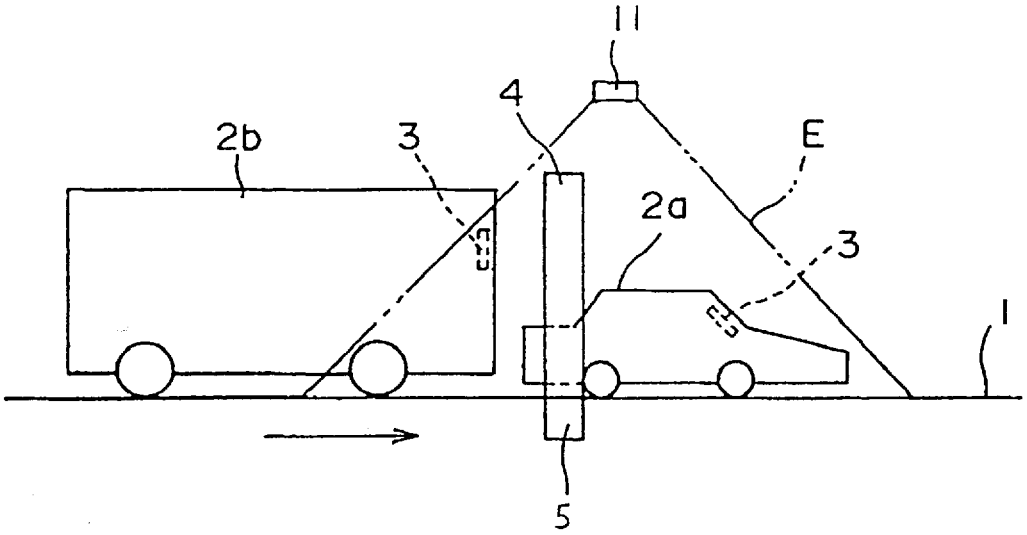
FIG. 12 is a schematic side view for explaining a cause generating the preceding and succeeding vehicles interference between a passenger car and a bus.

Here, as a succeeding vehicle 2*b* comes close to a preceding vehicle 2*a* before the vehicle 2*a* passes the optical sensor 4 as shown in FIG. 12, the OBE 3 of the succeeding vehicle 2*b* enters into the communication area E of the first antenna 11. Thus, two OBE 3 are present in the same communication area E, causing interference. Such interference caused between a preceding vehicle and a succeeding vehicle is called preceding and succeeding vehicle interference.

In the conventional technique, in order prevent this preceding and succeeding vehicle interference, vehicle drivers were urged to leave enough distance between vehicles.

Figure 13:
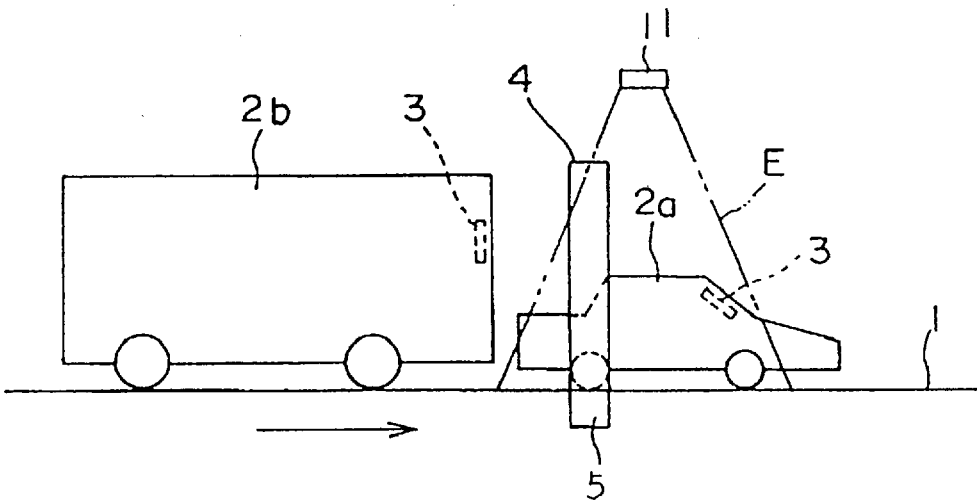
FIG. 13 is a schematic side view for explaining an embodiment aiming at the prevention of the preceding and succeeding vehicle interference of the toll collection system of the present invention.

So, in this embodiment, the preceding and succeeding vehicle interference is prevented by stopping the radio wave transmission from the first antenna 11 when the second axle of the vehicle 2*a* passes tread sensor 5 as shown in FIG. 13.

Figure 14:
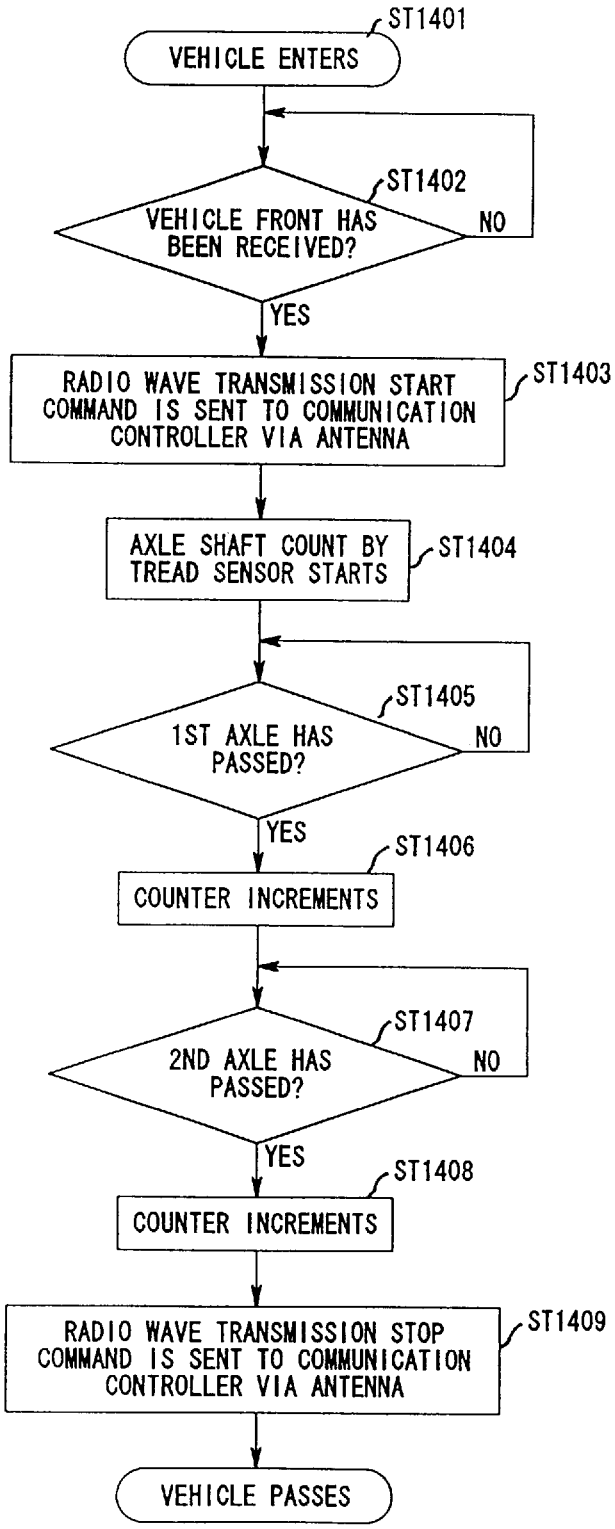
FIGS. 14 and 15 are flowcharts for explaining the operations of the controller at the entrance lane of the toll collection system of the present invention.
Figure 15:
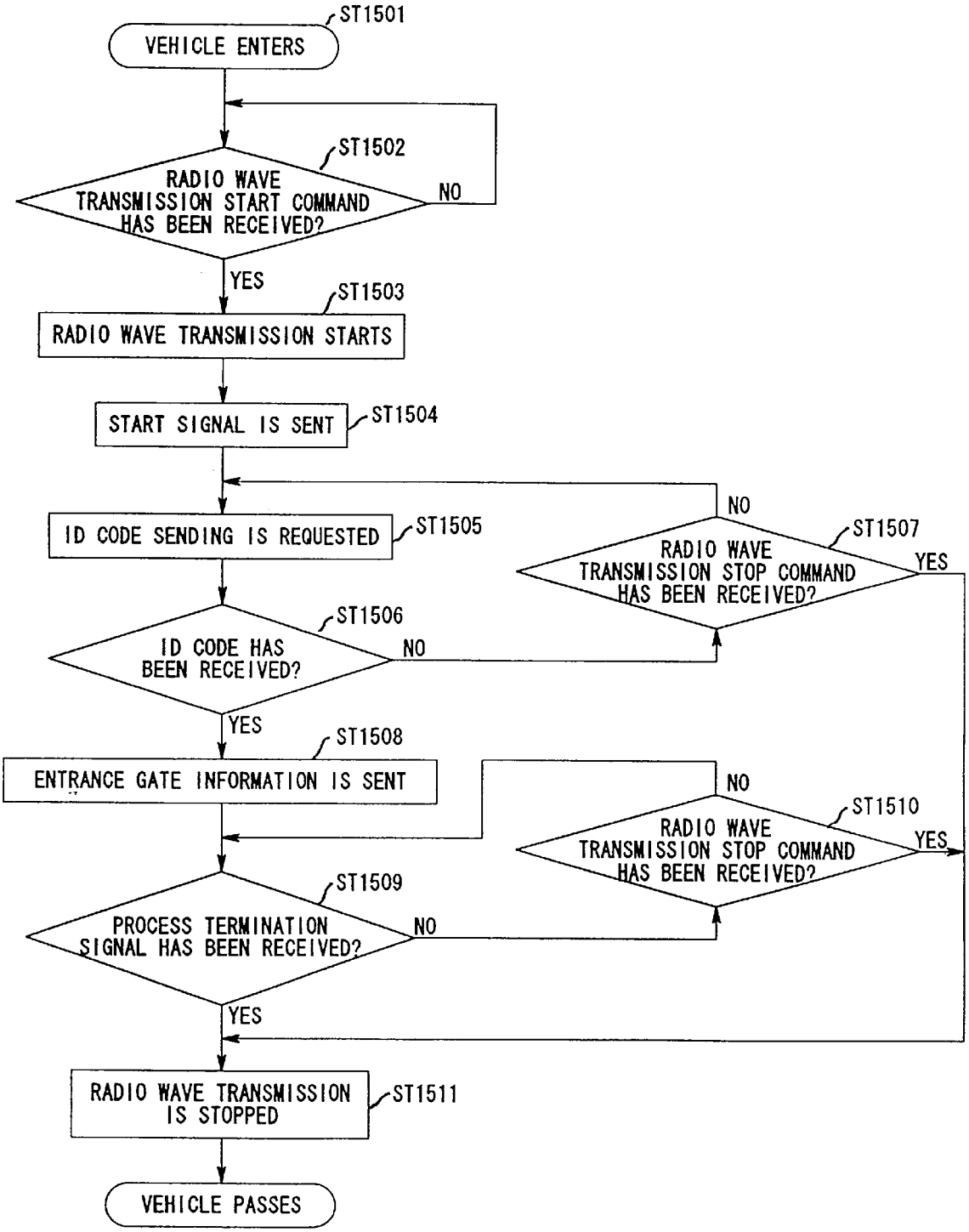

The prevention of the preceding and succeeding interference will be explained definitely in the following referring to the flowcharts shown in FIGS. 14 and 15.

When the vehicle 2 is coming into the entrance gate (ST1401, ST1501), the optical sensor 4 is covered by the vehicle 2 and the main controller 40 detects the front of the vehicle 2 based on the output signal from the optical sensor 4 (ST1402). When detecting the front of the vehicle 2, the main controller 40 transmits a radio wave transmission start command to the first communication controller 42 (ST1403). Upon receipt of this radio wave transmission start command (ST1502), the first communication controller 42 starts the radio wave transmission via the first antenna 11 (ST1503) and executes the communication process to the OBE 3 of the vehicle 2.

That is, upon receipt of the radio wave transmission start command from the main controller 40, the first communication controller 42 starts the radio wave transmission via the first antenna 11 (ST1503) and transmits a start signal to the OBE 3 of the vehicle 2 for starting the OBE 3 (ST1504) and requests the OBE 3 to send its ID code (ST1505).

When the start signal is received from the first antenna 11, the OBE 3 is started by this start signal and when the ID code sending request is received, the ID code stored in the memory 16 of the OBE 3 is sent to the first antenna 11.

The first communication controller 42 judges whether the ID code sent from the OBE3 could be received (ST1506). When the result of the judgment reveals that no ID code could be received, the first communication controller 42 judges whether the radio wave transmission stop command has been received from the main controller 40 (ST1507). When the result of the judgment reveals that no radio wave transmission stop command was received, the operation is made again to request the OBE 3 to send the ID code (ST1505).

If the radio wave transmission stop command is received from the main controller 40 before receiving the ID code from the OBE 3, the radio wave transmission via the first antenna 11 is stopped (ST1511). That is, when ID code sending request was sent to the OBE 3 of the vehicle 2 and the radio wave transmission stop command was received before receiving the ID code from the OBE 3, the radio communication with the OBE 3 carried on the vehicle 2 is stopped at that point of time.

In this case, the main controller 40 judges that the communication is erroneous or the vehicle has no OBE 3 and starts the operation to issue a ticket by the ATIM 7 based on the result of vehicle type discrimination, which will be described later.

When an ID code is received from the OBE 3 before receiving the radio wave transmission stop command from the main controller 40, the main controller 40 transmits the entrance gate information (e.g., the entrance gate number, passing time, discriminated vehicle type information, etc.) for the vehicle 2 to the OBE 3 via the first antenna 11 (ST1508).

Upon receipt of the entrance gate information from the first antenna 11, the OBE 3 stores that entrance gate information in the memory 16 and transmits a process termination signal to the first antenna 11.

The first communication controller 42 judges whether the process termination signal sent from the OBE 3 could be received (ST1509) and if not, judges whether the radio wave transmission stop command has been received from the main controller 40 (ST1510). If the command was not received, the first communication controller 42 repeats the operation to judge whether the process termination signal from the OBE 3 could be received (ST1509).

When the radio wave transmission stop command has been received from the main controller 40 before receiving the process termination signal from the OBE 3, the radio wave transmission via the first antenna 11 is stopped (ST1511). In this case, judging that a communication error occurred, the main controller 40 starts the ticket issuing operation by the ATIM 7 based on the result of a vehicle type discrimination, which will be described later.

When the process termination signal is received from the OBE 3 before receiving the radio transmission stop command from the main controller 40, the radio wave transmission via the first antenna 11 is stopped. That is, when the radio communication process with the OBE 3 carried on the vehicle 2 has been properly completed before receiving the radio transmission stop command from the main controller 40, the radio communication with the OBE 3 carried on the vehicle 2 is stopped at that point of time.

Further, the main controller 40 transmits the radio transmission start command to the first communication controller 42 and starts the axle counting process of the vehicle 2 (ST1404). That is, when the tread sensor 5 detects the passage of the first axle of the incoming vehicle 2 (ST1405), the main controller 40 increments the count of the axle shaft counter 18 by one (ST1406). Further, when the tread sensor 5 detects the passage of the second axle (ST1407), the main controller 40 further increments the count of the axle shaft counter 18 by one (ST1408) and transmits the radio wave transmission stop command for stopping the radio wave transmission via the first antenna 11 (ST1409).

Upon receipt of the radio wave transmission stop command, the first communication controller 42 stops the radio wave transmission via the first antenna 11 (ST1511) as described above and stops the radio communication with the OBE 3 carried on the vehicle 2.

Further, the main controller 40 performs the vehicle type discriminating process based on the output signal from the optical sensor 4. That is, when the incoming vehicle 2 passes between the light emitting portion and the light receiving portion of the optical sensor 4, the main controller 40 reads the bright and dark state of the light receiving elements of the light receiving portion according to the type of vehicle 2 at regular intervals, stores the read information in a RAM (not shown) temporarily and obtains the projective information of the side of the vehicle 2.

Then, using the projective information stored in the RAM as an input information (an input pattern), the main controller 40 executes the pattern matching process of the projective information with the vehicle standard information (the standard patterns) which have been registered (stored) in the ROM (not shown) in advance, computes the degree of similarity, and by obtaining the standard information of the highest degree of similarity, judges the vehicle type.

The result of vehicle type determination thus obtained is transmitted to the OBE 3 via the first antenna 11 as the vehicle type information determined at the entrance gate and is used for the ticket issuing operation by the ATIM 7.

According to the embodiment as described above, the front of an incoming vehicle is detected, the radio communication with an OBE of the incoming vehicle is started and when the second axle of the vehicle passes the tread sensor, the radio wave transmission to the OBE of the vehicle via the antenna is stopped. Thus, even when the incoming vehicle is very close to a succeeding vehicle and enough distance cannot be kept between them, the radio wave transmission is stopped when the second axle of the incoming vehicle passes the tread sensor and so, two OBEs will scarcely exist simultaneously in the same communication area. Therefore, the process will be performed for the OBE of the incoming vehicle only and the problem of preceding and succeeding vehicle interference can be prevented.

Thus, it becomes possible to reduce the process error resulting from the preceding and succeeding vehicle interference which occurred often and to properly perform the communication process with an OBE carried on a vehicle.

Further, when the radio communication with an OBE on the vehicle has been properly completed before detecting the second axle of the vehicle or when the ID code sending request was transmitted to the OBE carried on the vehicle and the second axle of the vehicle has been detected before receiving an ID code from the OBE, the radio communication with the OBE carried on the vehicle is stopped and thus, the action and effect similar to those described above are obtained.

Figure 16:
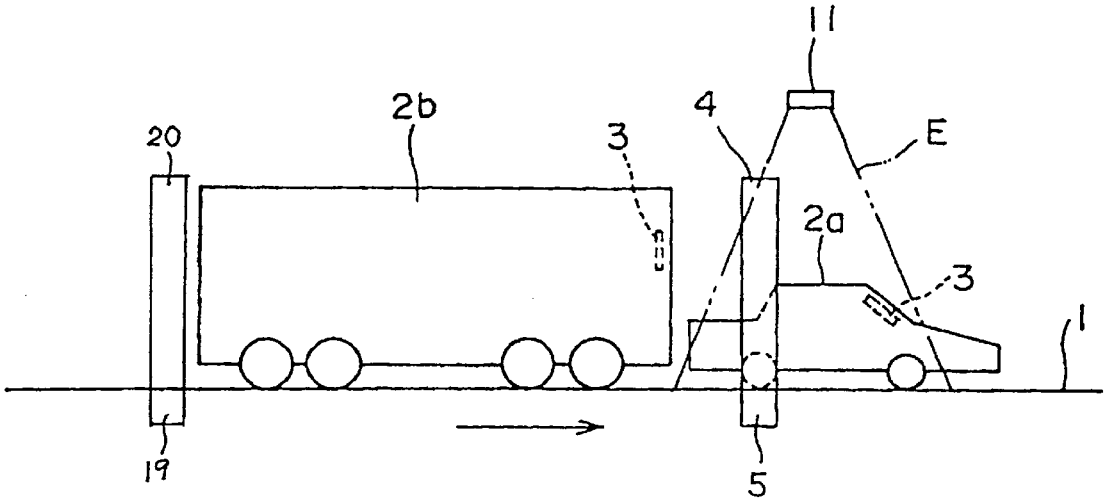
FIG. 16 is a schematic side view for explaining another embodiment of the present invention.

Further, in the embodiment described above, a case was described, wherein the radio communication with the OBE 3 carried on an incoming vehicle 2 is stopped when the second axle of the vehicle 2 is detected. The present invention is not limited to this case. For instance, a tread sensor 19 and an optical sensor 20 are additionally provided as an axle detecting means for detecting the axle of an incoming vehicle 2 at the location away from the tread sensor 5 by a prescribed distance in front of the tread sensor 5 of the entrance lane 1 as shown in FIG. 16.

That is, while the optical sensor 20 is detecting a vehicle 2*b*, a vehicle axle detecting signal is transmitted from the tread sensor 19 to the vehicle shaft counter 18 for the vehicle shaft counting. By this counting action, the total number of axles of an incoming vehicle 2 is first counted. If the detected number of axles is more than 3, the radio communication with an OBE 3 of the vehicle 2 is stopped when the number of axles less than the total axles by one is detected or the number of axles equal to the total axles is detected by the axle detecting signal from the tread sensor 19. Thus, the same action and effect as in the embodiment described above is obtained for a vehicle 2 which has many axles. The number of axles less than the total axles is detected for a long and large-sized vehicle, e.g., large-sized bus and trailer, as an OBE 3 may be installed at the rear in the vehicle. That is, this is to make the radio communication possible even when an OBE 3 is provided at a position in the rear of the second axle of a vehicle in case of such a long and large-sized vehicle.

In the embodiment described above, this system has been explained by taking the radio communication at the entrance gate of a tollhouse as an example, but this invention is not limited to this embodiment, it is also applicable to the communication process at an exit gate of a tollhouse. Further, it is also applicable to the communication process at an entrance port of a traffic facility such as a parking area.

In the embodiment described above, a method of preventing preceding and succeeding vehicle interference when a vehicle 2 passes the first antenna 11 has been described. This method is not limited to such an embodiment. However, it will be more effective if applied in the same manner as in the above-mentioned embodiment when a vehicle passes the second antenna 12 and the third antenna 13.

According to the present invention as described above, the system that is provided by the present invention is constructed such that a vehicle type of a vehicle coming into the entrance gate is determined, fixed data relative to the entrance gate are first transmitted to the incoming vehicle and then, variable data relative to the vehicle are transmitted. It is therefore possible to secure sufficient time for communication with the vehicle and to allow the vehicle to pass through the tollgate smoothly without suddenly stopping. Thus, safety is strongly promoted while reducing tollgate passing time, eliminating traffic snarl and reducing the burden on the user.

Further, according to the present invention, it is also possible to reduce process errors resulting from the preceding and succeeding vehicle interference often generated and properly carry out the communication process with a radio communication medium provided on a vehicle.

What is claimed is:

1. A radio communication system, provided at an entrance gate of traffic facilities, for radio communicating with a communication device carried by a vehicle, the radio communication system comprising:

first communication means, at a first side of the entrance gate, for transmitting a first entrance data relative to the entrance gate of the traffic facilities to the communication device carried by the vehicle coming into the entrance gate;

means for determining a vehicle type of the vehicle based on an overall length of the vehicle optically detected by the determining means; and second communication means, provided at a second side of the entrance gate opposite the first side of the entrance gate along a direction of progress of the vehicle, for transmitting a second entrance data including data relative to the determined vehicle type to the communication device when the first communication means transmits the first entrance data to the communication device.

2. The radio communication system as claimed in claim 1 further comprising means, provided on the second side of the entrance gate along the direction of progress of the vehicle, for issuing a ticket onto which the first entrance data is recorded when the first communication means does not transmit the first entrance data to the communication device.

3. The radio communication system as claimed in claim 1, wherein:

the determining means obtains projective information of the vehicle from an optical sensing device and compares a pattern of the projective information with previously stored standard patterns to determine the vehicle type.

4. The radio communication system as claimed in claim 2, wherein:

the determining means obtains projective information of the vehicle from an optical sensing device and compares a pattern of the projective information with previously stored standard patterns to determine the vehicle type.

5. The radio communication system as claimed in claim 1, wherein:

the determining means further determines the vehicle type based on a kind of number plate on the vehicle perceived by a video camera.

6. A toll collection system having an entrance gate processing apparatus, provided at an entrance gate of a toll road, for communicating with a communication device carried by a vehicle and an exit gate processing apparatus, provided at an exit gate of the toll road, for communicating with the communication device and calculating a toll, the system comprising:

the entrance gate processing apparatus including: first communication means, at a first side of the entrance gate, for transmitting a first entrance data relative to the entrance gate of the toll road to the communication device carried by the vehicle;

means for determining a vehicle type of the vehicle;

second communication means, provided at a second side of the entrance gate opposite the first side of the entrance gate along a direction of progress of the vehicle, for transmitting a second entrance data including data relative to the determined vehicle type to the communication device when the first communication means transmits the first entrance data to the communication device; and issuing means, provided on the second side of the entrance gate along the direction of progress of the vehicle, for issuing a ticket onto which the first and the second entrance data are recorded when the first communication means does not transmit the first entrance data to the communication device, and the exit gate processing apparatus including:

third communication means for receiving the first and the second entrance data from the communication device;

first calculation means for calculating the toll of the vehicle carrying the communication device based on received data when the third communication means receives the first and the second entrance data; and second calculation means for calculating the toll of the vehicle based on the first and the second entrance data recorded on the ticket when the third communication means does not receive the first entrance data.

7. The toll collection system as claimed in claim 6, wherein the exit gate processing apparatus further comprises:

input means for inputting data corresponding to the second entrance data when the third communication means does not receive the second entrance data; and third calculation means for calculating the toll of the vehicle based on the first entrance data received by the third communication means and the data input by the input means.

8. The toll collection system as claimed in claim 7, wherein the exit gate processing apparatus further includes means for informing of an abnormality when the third communication means does not receive one of the first and the second entrance data.

9. A radio communication system comprising:

vehicle detection means for detecting a vehicle, carrying an on-board equipment, coming into a prescribed location;

axle detection means for detecting a number of axles of the incoming vehicle; and radio communication means for starting a radio communication with the on-board equipment carried by the incoming vehicle when the vehicle detection means detects the incoming vehicle and stopping the radio comnunication with the on-board equipment carried by the incoming vehicle in response to the axle detection means detecting a second axle of the incoming vehicle.

10. The radio communication system as claimed in claim 9 further comprising control means for stopping the radio communication between the on-board equipment and the radio communication means when a proper completion of the radio communication with the on-board equipment carried by the incoming vehicle is detected before the axle detecting means detects the second axle of the incoming vehicle.

11. A radio communication system for communicating with an on-board equipment, which stores prescribed information including peculiar ID information, carried by a vehicle incoming into a prescribed location, the radio communication system comprising:

means for detecting the incoming vehicle;

axle detection means for detecting a number of axles of the incoming vehicle;

first communication means for starting a radio communication with the on-board equipment carried by the incoming vehicle when the detecting means detects the incoming vehicle and requesting the on-board equipment to transmit the peculiar ID information;

ID information receipt detection means for detecting whether the peculiar ID information is received from the on-board equipment in response to a request of the first communication means;

second communication means for exchanging required information with the on-board equipment when the ID information receipt detection means detects a receipt of the peculiar ID information; and control means for stopping the radio communication with the on-board equipment when the axle detection means detects a second axle of the incoming vehicle even if the ID information receipt detection means does not detect the receipt of the peculiar ID information.

12. The radio communication system as claimed in claim 11, wherein the first communication means includes means for sending a start signal, for starting an operation of the on-board equipment, to the on-board equipment carried by the incoming vehicle.

13. The radio communication system as claimed in claim 11 further comprising second control means for stopping an operation of the second communication means when a proper completion of an operation of the second communication means is detected before the axle detection means detects the second axle of the incoming vehicle.

14. A toll collection system for exchanging required information through a radio communication with an on-board equipment carried by a vehicle coming into a prescribed location, the toll collection system comprising:

first axle detection means for detecting a total number of axles of the vehicle;

vehicle detection means for detecting the vehicle;

second axle detection means for detecting a number of axles of the vehicle; and control means for starting the radio communication with the on-board equipment carried by the vehicle when the vehicle detection means detects the vehicle and stopping the radio communication with the on-board equipment when the second axle detection means detects the number of axles being less than the total number of axles by one if the total number of axles detected by the first axle detection means is more than 2.

15. A toll collection system having an entrance gate processing apparatus, provided at an entrance gate of a toll road, for communicating with a communication device carried by a vehicle and an exit gate processing apparatus, provided at an exit gate of the toll road, for communicating with the communication device and calculating a toll, the toll collection system comprising:

the entrance gate processing apparatus including:

vehicle detection means for detecting the vehicle coming into the entrance gate;

axle detection means for detecting a number of axles of the incoming vehicle;

first communication means, at a first side of the entrance gate, for starting a transmission of a first entrance data relative to the entrance gate to the communication device carried by the incoming vehicle when the vehicle detection means detects the incoming vehicle and stopping the transmission of the first entrance data to the communication device when the axle detection means detects a second axle of the incoming vehicle;

means for determining a vehicle type showing a kind of incoming vehicle;

second communication means, provided at a second side of the entrance gate opposite the first side of the entrance gate along a direction of progress of the vehicle, for transmitting a second entrance data including data relative to the determined vehicle type to the communication device when the first communication means transmits the first entrance data to the communication device; and means, provided on the second side of the entrance gate along the direction of progress of the vehicle, for issuing a ticket onto which the first and the second entrance data are recorded when the first communication means does not transmit the first entrance data to the communication device; and the exit gate processing apparatus including:

third communication means for receiving the first and the second entrance data from the communication device;

first calculation means for calculating the toll of the vehicle carrying the communication device based on received data when the third communication means receives the first and second entrance data; and second calculation means for calculating the toll of the vehicle based on the first and the second entrance data recorded on the ticket when the third communication means does not receive the first and the second entrance data.

16. A radio communication system provided at an entrance gate of traffic facilities, for radio communicating with a communication device carried by a vehicle, the radio communication system comprising:

first communication means, at a first side of the entrance gate, for transmitting a first entrance data relative to the entrance gate of the traffic facilities to the communication device carried by the vehicle coming into the entrance gate;

means for determining a vehicle type of the vehicle based on a kind of number plate on the vehicle perceived by a video camera;

second communication means, provided at a second side of the entrance gate opposite the first side of the entrance gate along a direction of progress of the vehicle, for transmitting a second entrance data including data relative to the determined vehicle type to the communication device.

* * * * *